United States Patent [19]

Takahashi

[11] Patent Number: 4,947,782

[45] Date of Patent: Aug. 14, 1990

[54] REMOTELY OPERATED VEHICLE

[75] Inventor: Yasuo Takahashi, Yokohama, Japan

[73] Assignee: Mitsui Engineering & Shipbuilding Co., Ltd., Tokyo, Japan

[21] Appl. No.: 394,896

[22] Filed: Aug. 17, 1989

[30] Foreign Application Priority Data

Aug. 30, 1988 [JP] Japan ..... 63-213659

[51] Int. Cl.[5] ..... B63B 39/02; B63G 8/26

[52] U.S. Cl. ..... 114/312; 114/124; 114/330; 114/338

[58] Field of Search ..... 114/330, 333, 337, 338, 114/124, 312

[56] References Cited

U.S. PATENT DOCUMENTS

| | | | |
|---|---|---|---|
| 1,096,192 | 5/1914 | Pleva | 114/124 |
| 2,263,553 | 11/1941 | Borracci | 114/330 |
| 3,199,482 | 10/1965 | Jaffee | 114/330 |
| 3,434,443 | 3/1969 | Estabrook | 114/330 |
| 3,521,589 | 7/1970 | Kemp | 114/330 |
| 3,688,720 | 9/1972 | Lok | 114/333 |
| 3,809,000 | 5/1974 | Horsford et al. | 114/124 |
| 4,014,280 | 3/1977 | Laxo | 114/330 |
| 4,721,055 | 1/1988 | Pado | 114/330 |
| 4,802,429 | 2/1989 | Butka | 114/124 |

FOREIGN PATENT DOCUMENTS 61-36095 2/1986 Japan .

*Primary Examiner*—David H. Brown

*Attorney, Agent, or Firm*—Armstrong, Nikaido, Marmelstein, Kubovcik & Murray

[57] ABSTRACT

A remotely operated vehicle (ROV) provided with not less than three thrusters arranged in the longitudinal direction of a vehicle body. The center of gravity G of the vehicle body excluding a pendulum and the center of buoyancy B of the vehicle body including the pendulum are set in agreement with each other, and the pendulum is provided so that it can be turned around a Y-axis extending in the lateral direction of the vehicle body and passing the center of gravity G thereof.

4 Claims, 5 Drawing Sheets

REMOTELY OPERATED VEHICLE

BACKGROUND OF THE INVENTION

This invention relates to a remotely operated vehicle (ROV), and more particularly to a ROV having excellent pitching motion characteristics and a high steerability.

In general, a conventional ROV suspended from a ship into water and adapted to make underwater survey and investigation by a remote control operation carried out from the ship is loaded with a TV camera, and operator operates the ROV as the operator monitors an image, which is transmitted from the TV camera, on a video monitor.

However, in such a conventional ROV, the TV camera alone is tilted during an imaging operation. Therefore, when the angle of tilt of the TV camera becomes large, the field of vision of the TV camera departs from the range of the light projected by an underwater light, so that the image on the video monitor becomes vague.

Although it is possible to move the underwater light in accordance with a movement of the TV camera, a mechanism for operatively connecting the underwater light and TV camera together becomes complicated.

A ROV having a TV camera set firmly therein, wherein the pitch angle of the ROV is regulated by moving a weight has also been proposed (Japanese patent application Kokai publication No. 61-36095).

However, the pitch angle of this submarine robot cannot be controlled rapidly.

In order to speedily control the pitch angle of the ROV, it is necessary to move the weight speedily in the longitudinal direction of the ROV. However, when the moving speed of the weight is high, pitching occurs due to a reaction force. Moreover, this ROV requires means for moving the weight in the longitudinal direction of the ROV. This increases the weight of the ROV accordingly, and complicates the construction thereof.

Summary of the Invention:

The present invention has been developed in view of such drawbacks encountered in the conventional ROV. An object of the present invention is to provide a ROV weighing not much more than a conventional ROV and having a simple construction, excellent pitching motion characteristics and a high steerability.

The ROV according to the present invention has not less than three thrusters arranged in the longitudinal direction of a vehicle body, and is characterized in that the center of gravity G of vehicle body excluding a pendulum and the center of buoyancy B of the vehicle body including the pendulum are set in agreement with each other, the pendulum being disposed so that it can be turned around a lateral axis of the vehicle body which passes the center of gravity G of the vehicle body.

DESCRIPTION OF THE PREFERRED EMBODIMENTS

The embodiments of the present invention will now be described with reference to the drawings.

Figure 1:
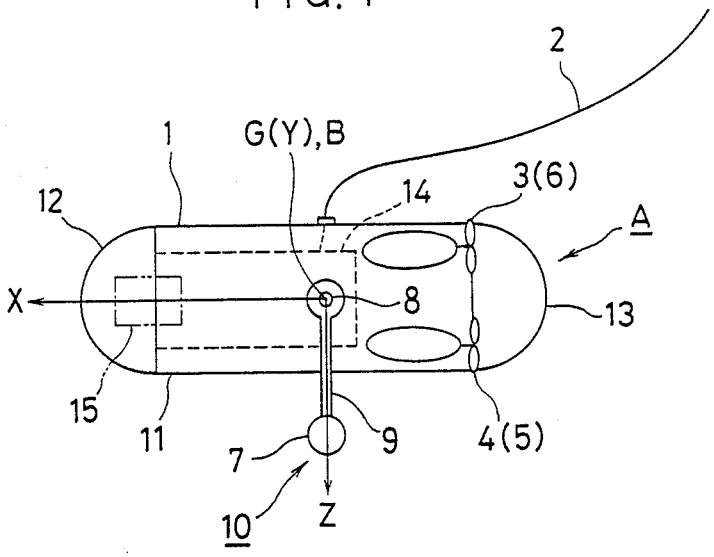
FIG. 1 is a side elevation of the ROV according to the present invention.

Referring to FIG. 1, a reference letter A denotes a ROV, a vehicle body 1 of which consists of a cylindrical trunk 11, and transparent hemispherical domes 12 and 13 attached to the front and rear ends of the trunk 11.

The vehicle body 1 contains a TV camera 14 fixed therein so as to face in the forward direction. Four thrusters 3, 4, 5 and 6 are fixed to the rear portion of the vehicle body 1 so as to face in the forward direction of the vehicle body 1.

Figure 2:
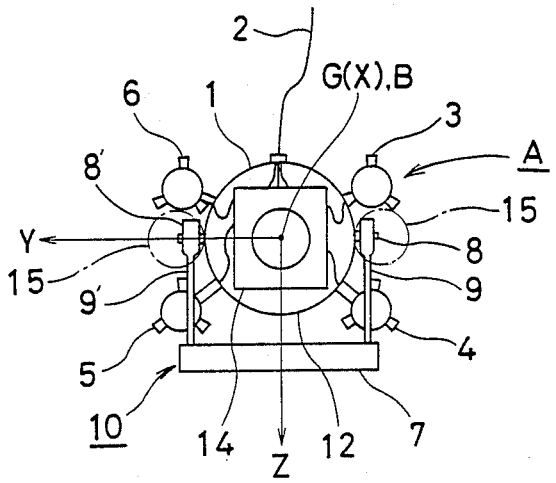
FIG. 2 is a front elevation of the ROV according to the present invention.

As shown in FIG. 2, the thruster 3 is provided on a diagonally upper right portion of the vehicle body 1, the thruster 4 a diagonally lower right portion thereof, the thruster 5 a diagonally lower left portion thereof, and the thruster 6 a diagonally upper left portion thereof. Two underwater lights 15 are provided on the left and right side portions of the vehicle body 1 so as to face in the forward direction.

A tether cable 2 consists of such as a power cable, a control cable and a transmission cable. The electric power is supplied to the thrusters 3–6, TV camera 14 and underwater lights 15 through the power cable, and a control signal to the thrusters 3–6 and TV camera 14 through the control cable. The image on the TV camera 14 is transmitted to a video monitor (not shown) on a ship through the transmission cable.

As shown in FIG. 1, the vehicle body 1 is formed so that the center of gravity G of the vehicle body 1 excluding the weight W of a pendulum 10 and the center of buoyance B of the vehicle body 1 including the weight W of the pendulum coincide with each other.

The coordinates of the vehicle body 1 will now be drawn, which has an origin representative of the center of gravity G of the vehicle body 1, an X-axis the longitudinal axis thereof, a Y-axis the lateral axis thereof, and a Z-axis the vertical axis thereof.

The vehicle body 1 is provided at both side portions thereof with fixed shafts 8 and 8' the axes of which are in alignment with the Y-axis passing the center of gravity G of the vehicle body 1, and the pendulum 10 comprises arms 9 and 9' pivotably supported on these fixed shafts 8 and 8' respectively, and a rod type weight 7 secured to the lower ends of these arms 9 and 9'.

Accordingly, even when the vehicle body 1 pitches, the pendulum 10 always faces in a direction in which the gravity works, and a restoring force for returning the vehicle body 1 to a horizontal position does not occur in the pendulum 10.

However, when the vehicle body 1 rolls, the pendulum 10 tilts with the vehicle body 1, so that a restoring force for returning the vehicle body 1 to a horizontal position occurs in the pendulum 10.

Figure 5:
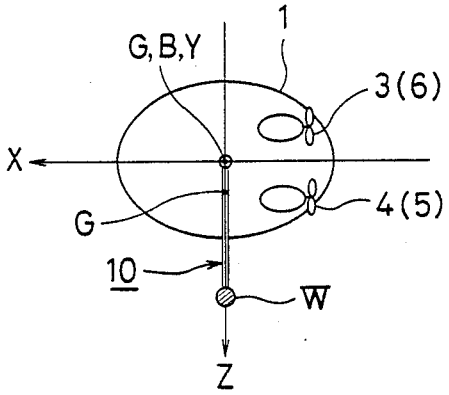
FIGS. 5 (*a*), 5 (*b*), 6 (*a*), 6 (*b*), 7 (*a*) and 7 (*b*) illustrate the motion characteristics of the ROV according to the present invention.
Figure 5:
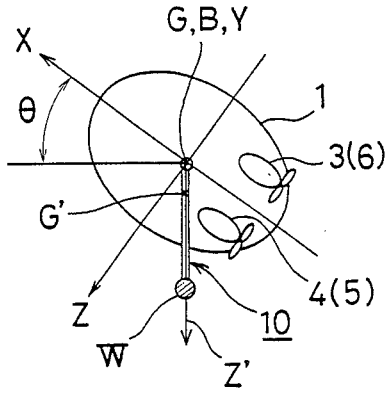

FIGS. 5 (*a*), 5 (*b*), 6 (*a*), 6 (*b*), 7 (*a*) and 7 (*b*) illustrate the motion characteristics of the ROV A. Referring to FIG. 5 (*a*), an arrangement is made such that the center of gravity G of the vehicle body 1 excluding the weight W of the pendulum 10 and the center of buoyancy B of the Vehicle body 1 including the weight W of the pendulum 10 agree with each other. When the pendulum 10 of the weight W is fixed to the vehicle body 1, the center of gravity G' of the vehicle body 1 moves to a position on the Z-axis which passes the center of gravity G of the vehicle body 1 excluding the weight W of the pendulum 10.

When the vehicle body 1 keeping a horizontal posture as shown in FIG. 5 (*a*) is tilted clockwise by an angle $\theta$ as shown in FIG. 5 (*b*), the center of buoyancy B of the vehicle body 1, the secondary center of gravity G' thereof and the pendulum 10 are positioned on the vertical line Z' passing the center of gravity G of the vehicle body 1 excluding the weight W of the pendulum.

Therefore, the restoring moment $Mp_1$ with respect to the pitch angle $\theta$ remains to be zero as shown in the equation (1).

$$Mp_1 = 0 \ldots \quad (1)$$

This means that the pitching motion, i.e. tilting motion of the vehicle body 1 can be made simply without being influenced by the restoring moment $Mp_1$.

Figure 6:
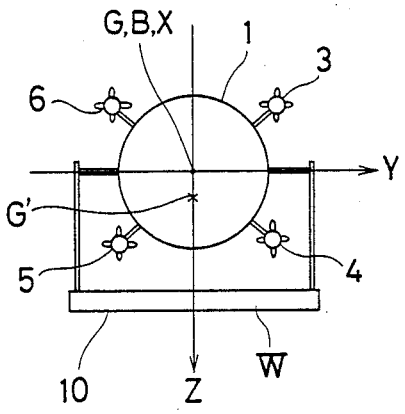
Figure 6:
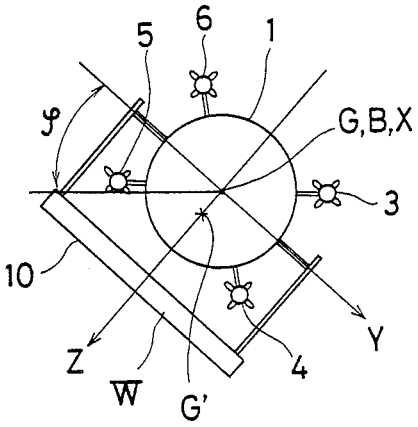

The ROV A according to the present invention receives a restoring force with respect to a roll angle $\zeta$ and a yaw angle $\phi$, and is stable with respect thereto. Accordingly, it can be said that the steerability of this ROV is excellent. FIG. 6 (*a*) is a front elevation of the vehicle body 1 in a horizontal posture retaining state. When the vehicle body 1 is tilted clockwise by an angle $\zeta$ as shown in FIG. 6 (*b*), a restoring force $Mp_2$ with respect to the roll angle $\zeta$ works on the vehicle body 1. Namely, the restoring moment $Mp_2$ is expressed by the equation (2).

$$Mp_2 = W \cdot BG' \cdot \sin\zeta \ldots \quad (2)$$

Figure 7:
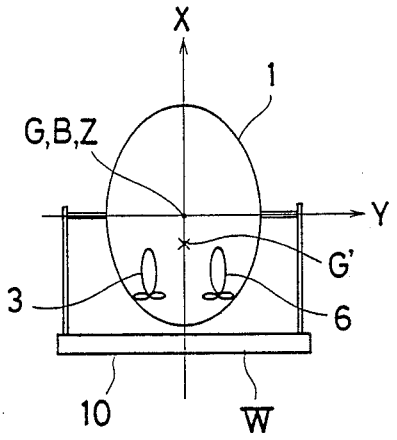
Figure 7:
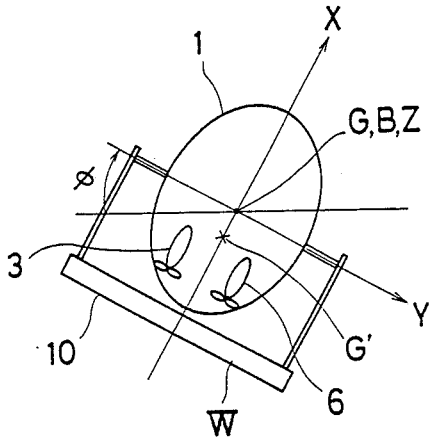

FIG. 7 (*a*) shows the vehicle body 1 with its nose facing in the perpendicularly upward direction. When this vehicle body 1 is tilted clockwise around the Z-axis by an angle $\phi$, a restoring force $Mp_3$ with respect to the yaw angle $\phi$ works on the vehicle body 1. Namely, the restoring moment $Mp_3$ is expressed by the equation (3).

$$Mp_3 = W \cdot BG' \cdot \sin\phi \ldots \quad (3)$$

The operation of the ROV according to the present invention will now be described.

When the thrusts of the four thrusters 3–6 are set equal and in the same direction with the vehicle body kept horizontal as shown in FIG. 1, the ROV A moves straight in the forward or rearward direction.

When the thrusts of the right-hand thrusters 3, 4 in a front view of the vehicle body 1 and those of the left-hand thrusters 5, 6 in the same drawing are set in the opposite directions, the yaw moment around the Z-axis passing the center of gravity G of the vehicle body 1 occurs, so that the ROV A shakes its head rightward or leftward in FIG. 2.

Figure 3:
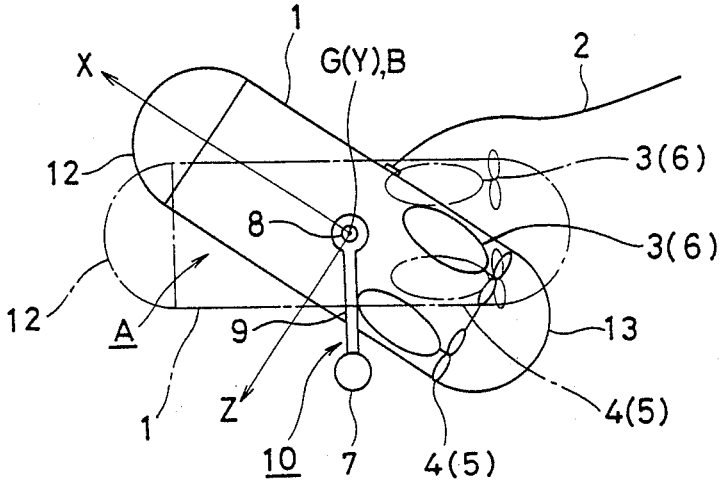
FIGS. 3 and 4 illustrate the pitching motion of the ROV according to the present invention.

When the thrusts of the upper thrusters 3, 6 are set in the backward direction with the thrusts of the lower thrusters 4, 5 set in the forward direction as shown in FIG. 3, the vehicle body 1 is turned clockwise around the Y-axis, so that the vehicle body 1 turns its face diagonally upward. When the direction of the thrusts of all the thrusters 3–6 are changed over to the forward direction after the vehicle body 1 has faced in a predetermined direction, the ROV A advances straight in the diagonal upper left direction.

Figure 4:
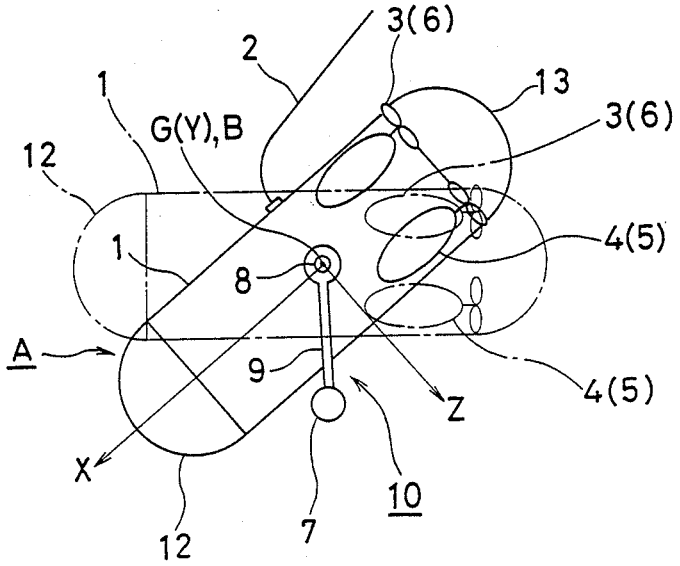

When the thrusts of the upper thrusters 3, 6 are set in the forward direction with the thrusts of the lower thrusters 4, 5 set in the backward direction as shown in FIG. 4, the vehicle body 1 is turned counter-clockwise around the Y-axis, so that the vehicle body 1 turns its face diagonally downward. When the direction of the thrusts of all the thrusters 3–6 are changed over to the forward direction after the vehicle body 1 has faced in a predetermined direction, the ROV A advances straight in the diagonal lower left direction.

Figure 8:
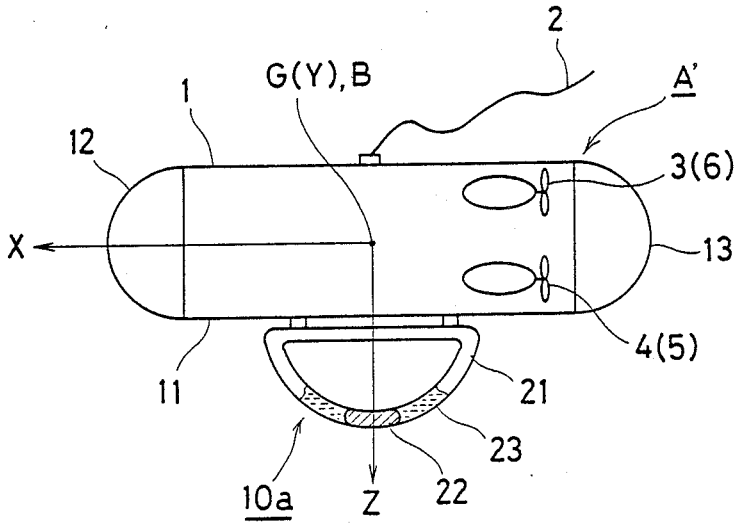
FIGS. 8 and 9 are side elevations of other embodiments of the ROV according to the present invention.

FIG. 8 shows an example A' of the ROV provided with another type of pendulum 10*a*, which consists of a tube 21 extending to form a closed semi-circular ring and containing mercury 22 sealed therein. This semi-circular or arcuate tube 21 has a radius of curvature the center of which corresponds in position to the center of gravity G of vehicle body 1. Further, the reference numeral 23 denotes water sealed in the tube 21. When the ROV A' in this example is moved forward and backward, a stable restoring force is obtained with the pendulum 10*a* not tilted owing to the fluid resistance.

Figure 9:
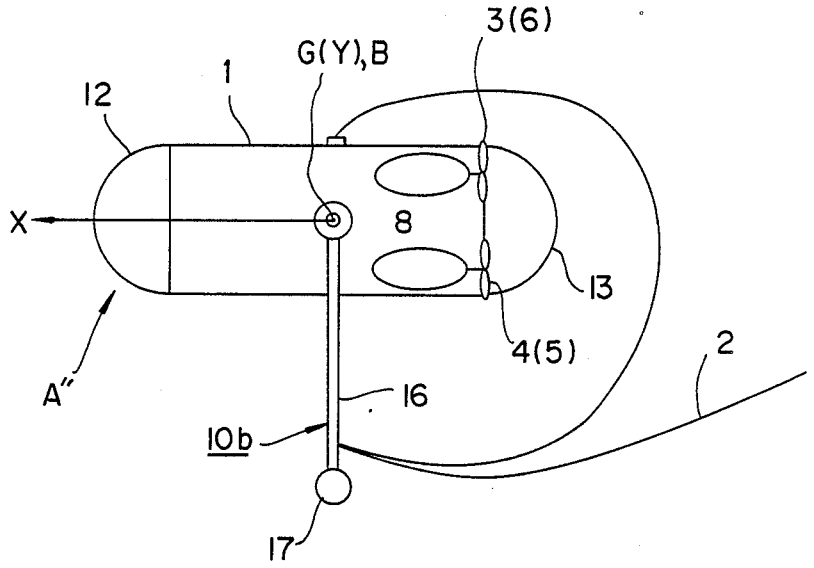

FIG. 9 shows an example A" of the ROV provided with still another type of pendulum 10*b*, which consists of a tether cable 2 for retaining arm 16 so that when the ROV is pulled up by way of the tether cable 2, impact is applied to the ROV and not to the connection between the cable 2 and the TV camera or any instrument inside the ROV. The retaining arm 16 is joined pivotably to operably fixed shafts 8, 8', and a weight 17 fixed to this arm 16.

Although the embodiments described above are provided with four thrusters, they may also be provided with three thrusters.

While the invention has been particularly shown and described in reference to preferred embodiments thereof, it will be understood by those skilled in the art that changes in form and details may be made therein without departing from the spirit and scope of the invention.

What is claimed is:

1. A remotely operated vehicle comprising a vehicle body; at least three thrusters arranged in the longitudinal direction of said vehicle body; a pendulum connected to said vehicle body, wherein the center of gravity of said vehicle body excluding said pendulum and the center of buoyancy of said vehicle body including said pendulum are set in agreement with each other, said pendulum being provided so that said pendulum can be turned around an axis extending in the lateral direction of said vehicle body and passing through said center of gravity of said vehicle body.

2. The remotely operated vehicle according to claim 1, wherein said vehicle body has, at both said portions thereof, fixed shafts, the axes of said shafts being in alignment with said axis extending in the lateral direction of said vehicle body and passing through said center of gravity of said vehicle body, said pendulum being joined pivotably to said fixed shafts, said pendulum having a pair of arms joined pivotably to said fixed shafts, and a rod type weight fixed to lower ends of said arms.

3. The remotely operated vehicle according to claim 1, wherein said pendulum includes a tube extending to form a closed semi-circular ring and mercury sealed in said tube, said tube having a radius of curvature with a center which corresponds to the position of said center of gravity of said vehicle body.

4. The remotely operated vehicle according to claim 1, wherein said vehicle body has, at both side portions thereof, fixed shafts, the axis of said shafts being in alignment with said axis extending in the lateral direction of said vehicle body and passing through said center of gravity of said vehicle body, said pendulum including tether cable retaining arms being pivotably coupled to said fixed shafts, and a weight fixed to said arms.

* * * * *